US010412530B2

(12) United States Patent
Konishi et al.

(10) Patent No.: US 10,412,530 B2
(45) Date of Patent: Sep. 10, 2019

(54) OUT-OF-HEAD LOCALIZATION PROCESSING APPARATUS AND FILTER SELECTION METHOD

(71) Applicant: JVC KENWOOD Corporation, Yokohama-shi, Kanagawa (JP)

(72) Inventors: Masaya Konishi, Yokohama (JP); Hisako Murata, Yokohama (JP); Yumi Fujii, Yokohama (JP)

(73) Assignee: JVCKENWOOD Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 15/895,293

(22) Filed: Feb. 13, 2018

(65) Prior Publication Data

US 2018/0176709 A1 Jun. 21, 2018

Related U.S. Application Data

(63) Continuation of application No. PCT/JP2016/003675, filed on Aug. 9, 2016.

(30) Foreign Application Priority Data

Aug. 20, 2015 (JP) ..... 2015-162406

(51) Int. Cl.
*H04S 1/00* (2006.01)
*H04S 5/02* (2006.01)
(Continued)

(52) U.S. Cl.
CPC ..... *H04S 7/304* (2013.01); *H04R 5/0335* (2013.01); *H04R 5/04* (2013.01); *H04S 1/00* (2013.01); *H04S 5/02* (2013.01)

(58) Field of Classification Search
CPC ..... H04R 5/0335; H04R 5/04; H04S 1/00; H04S 5/02; H04S 7/304
(Continued)

(56) References Cited

U.S. PATENT DOCUMENTS

2001/0012368 A1* 8/2001 Yamazaki ..... H04S 7/30 381/17
2008/0025518 A1* 1/2008 Mizuno ..... H04S 3/002 381/17
(Continued)

FOREIGN PATENT DOCUMENTS

JP 2002209300 A 7/2002
JP 2002269567 A 9/2002
(Continued)

*Primary Examiner* — Vivian C Chin
*Assistant Examiner* — Friedrich Fahnert
(74) *Attorney, Agent, or Firm* — Procopio, Cory, Hargreaves & Savitch LLP

(57) ABSTRACT

An out-of-head localization processing apparatus according to the embodiments includes a filter selection unit configured to select a preset filter, an out-of-head localization processing unit configured to perform out-of-head localization processing using the preset filter selected, headphones configured to output, to a user, a signal of a test sound source, an input unit configured to accept a user input, a sensor unit, a three-dimensional coordinate calculation unit configured to calculate three-dimensional coordinates of a localized position of a sound image based on a detection signal from the sensor unit, and an evaluation unit configured to evaluate, based on the three-dimensional coordinates of each of the preset filters, a filter optimal for the user from the plurality of preset filters.

15 Claims, 6 Drawing Sheets

(51) Int. Cl.
*H04R 5/04* (2006.01)
*H04S 7/00* (2006.01)
*H04R 5/033* (2006.01)

(58) Field of Classification Search
USPC ..... 381/1, 17, 303, 313, 18, 71.6, 74, 309, 381/310, 322
See application file for complete search history.

(56) References Cited

U.S. PATENT DOCUMENTS

| | | | | |
|---|---|---|---|---|
| 2009/0034745 | A1* | 2/2009 | Mizuno | H04S 1/002 381/1 |
| 2009/0141903 | A1* | 6/2009 | Watanabe | H04S 7/302 381/17 |
| 2012/0093320 | A1 | 4/2012 | Flaks et al. | |
| 2012/0213375 | A1* | 8/2012 | Mahabub | H04S 5/00 381/17 |
| 2014/0058662 | A1* | 2/2014 | Tachibana | G01C 21/00 701/428 |
| 2015/0181355 | A1* | 6/2015 | Pedersen | H04R 25/407 381/313 |
| 2015/0304790 | A1* | 10/2015 | Yamashita | G06F 21/32 381/303 |

FOREIGN PATENT DOCUMENTS

| | | | |
|---|---|---|---|
| JP | 2006180467 | A | 7/2006 |
| JP | 2009-284175 | A | 12/2009 |
| JP | 2014116722 | A | 6/2014 |

* cited by examiner

OUT-OF-HEAD LOCALIZATION PROCESSING APPARATUS AND FILTER SELECTION METHOD

CROSS REFERENCE TO RELATED APPLICATION

The present application is based upon and claims the benefit of priority from Japanese Patent Application No. 2015-162406, filed on Aug. 20, 2015, the entire contents of which are hereby incorporated by reference.

BACKGROUND

The present disclosure relates to an out-of-head localization processing apparatus and a filter selection method.

As one of the sound field reproduction techniques, there is an "out-of-head localization headphone technique" that generates a sound field as if sound is reproduced by speakers even when the sound is actually reproduced by headphones (Japanese Unexamined Patent Application Publication No. 2002-209300). The out-of-head localization headphone technique uses, for example, the head-related transfer characteristics of a listener (spatial transfer characteristics from 2ch virtual speakers placed in front of the listener to his/her left and right ears, respectively) and ear canal transfer characteristics of the listener (transfer characteristics from right and left diaphragms of headphones to the listener's ear canals, respectively).

In out-of-head localization reproduction, measurement signals (impulse sound etc.) output from two-channel (hereinafter referred to as ch) speakers are recorded by microphones placed in the listener's ears. Then, head-related transfer characteristics are calculated from impulse responses, and filters are created. The out-of-head localization reproduction can be achieved by convolving the created filters with 2ch music signals.

As shown in FIG. 6, a speaker unit 5 including an Lch speaker 5L and an Rch speaker 5R is used for measuring the impulse responses. The speaker unit 5 is placed in front of a user 1. Here, a signal reaching a left ear 3L from the Lch speaker 5L is referred to as Ls, a signal reaching a right ear 3R from the Rch speaker 5R is referred to as Rs, a signal reaching the right ear 3R around a head from the Lch speaker 5L is referred to as Lo, and a signal reaching the left ear 3L around the head from the Rch speaker 5R is referred to as Ro.

The impulse signals are individually emitted from the Lch speaker 5L and Rch speaker 5R, and impulse responses (Ls, Lo, Ro, Rs) are measured by left and right microphones 2L and 2R worn on the left ear 3L and the right ear 3R, respectively. By this measurement, each transfer characteristic can be obtained. By convoluting the obtained transfer characteristics with 2ch music signals, it is possible to achieve out-of-head localization processing as if sound is reproduced by speakers even when the sound is actually reproduced by headphones.

SUMMARY

However, sometimes the speakers for the measurement cannot be prepared depending on an actual listening environment, and thus the head-related transfer characteristics of the listener may not be obtained.

Therefore, as alternative means, a filter can be created using the head-related transfer characteristics measured by performing a measurement on another person, a dummy head, or the like. However, the head-related transfer characteristics are known to greatly differ depending on a shape of an individual's head and a shape of an auricle. Therefore, when the characteristics of another person are used, the out-of-head localization performance is often degraded considerably.

For this reason, it is preferable to use a preset method in which a plurality of different preset filters are prepared in advance. In the preset method, the listener can select the preset filter most suitable for him/her while listening to sound processed by the respective preset filters. By doing so, excellent out-of-head localization performance can be achieved.

In the preset method, when a large number of preset filters are prepared, there is a high possibility that the listener can select the preset filter close to his/her characteristics. However, the greater the number of preset filters, the more difficult it becomes to evaluate a difference in sound image localization by listening and select the optimal preset filter. Since the sound image localization is a spatial image such that "the sound is reproduced around here," the above-described tendency becomes more pronounced for a person who has never experienced the out-of-head localization. Further, as the sound image localization can only be perceived by the person listening to the sound, it is difficult to know from outside where the sound image is localized.

An example aspect of the embodiments is an out-of-head localization processing apparatus including: a sound source reproduction unit configured to reproduce a test sound source; a filter selection unit configured to select, from a plurality of preset filters, a preset filter to be used for out-of-head localization processing; an out-of-head localization processing unit configured to perform the out-of-head localization processing on a signal of the test sound source using the preset filter selected by the filter selection unit; headphones configured to output, to a user, the signal that has been subjected to the out-of-head localization processing by the out-of-head localization processing unit; an input unit configured to accept a user input for determining a localized position of a sound image in the out-of-head localization processing; a sensor unit configured to generate a detection signal indicating position information of the sound image to be detected; a three-dimensional coordinate calculation unit configured to calculate three-dimensional coordinates of the localized position based on the detection signal from the sensor unit; and an evaluation unit configured to evaluate, based on the three-dimensional coordinates of the localized position of each of the preset filters, a filter optimal for the user from the plurality of preset filters.

Another example aspect of the embodiments is a filter selection method including: selecting, from a plurality of preset filters, a preset filter to be used for out-of-head localization processing; reproducing a signal of a test sound source that has been subjected to the out-of-head localization processing using the selected preset filter; accepting a user input for determining a localized position of a sound image of the test sound source; acquiring, by a sensor unit, position information of the localized position determined by the user input; calculating three-dimensional coordinates of the localized position based on the position information; and determining, based on the three-dimensional coordinates of the sound image for each of the preset filters, an optimal filter from the plurality of preset filters.

According to the above embodiments, it is possible to provide an out-of-head localization apparatus and a filter selection method that can easily select a filter optimal for a user from a plurality of preset filters prepared in advance.

DETAILED DESCRIPTION

An overview of an out-of-head localization processing apparatus and a filter selection method according to this embodiment will be described.

With out-of-head localization headphones, the highest out-of-head localization performance can be derived by performing processing using head-related transfer characteristics of a listener himself/herself. However, due to reasons such that, for example, speakers for measurement cannot be prepared, the next best solution may be a preset method. In the preset method, the listener selects characteristics (filter) that are closest to his/her characteristics from a plurality of preset filters having characteristics of others prepared in advance.

In the preset method, the listener selects an optimal combination while listening to the sound processed by the plurality of preset filters in order. However, it is difficult to store the localized position of the sound image in each preset filter, and it is difficult for a beginner to select an optimal combination.

Therefore, in this embodiment, a sensor unit detects the localized position of the sound image in each preset filter. For example, the user wears a marker on his/her fingertip. Then, with the marker, the user points to the localized position of the sound image he/she perceived. By using the sensor unit to detect the position of the marker, the sound image localization information of each preset filter is quantified.

Specifically, a test sound source (such as white noise) which clarifies the sound image localization is reproduced using each preset filter. Then, the user indicates the localized positions of the sound images with his/her finger, the marker, or the like. Three-dimensional coordinates of the localized positions are measured using sensors placed one the headphones.

The processing apparatus stores the three-dimensional coordinates of the localized positions for the respective plurality of preset filters. The processing apparatus analyzes the three-dimensional coordinated data corresponding to the plurality of preset filters. The processing apparatus determines the combination with the highest out-of-head localization performance based on a result of the analysis. In this manner, the optimal out-of-head localization performance can be automatically obtained without the listener selecting a preset filter that is optimal for him/her (hereinafter referred to as an optimal filter) by himself/herself.

A distance from the user to the localized position of the sound image and a distance from virtual speakers to the localized position of the sound image may be used for evaluation of the out-of-head localization performance. For example, a preset filter having a sound image localized farthest from the user is selected as the optimal filter. Alternatively, a preset filter having a sound image localized closest to the virtual speakers is selected as the optimal filter.

First Embodiment

Figure 1:
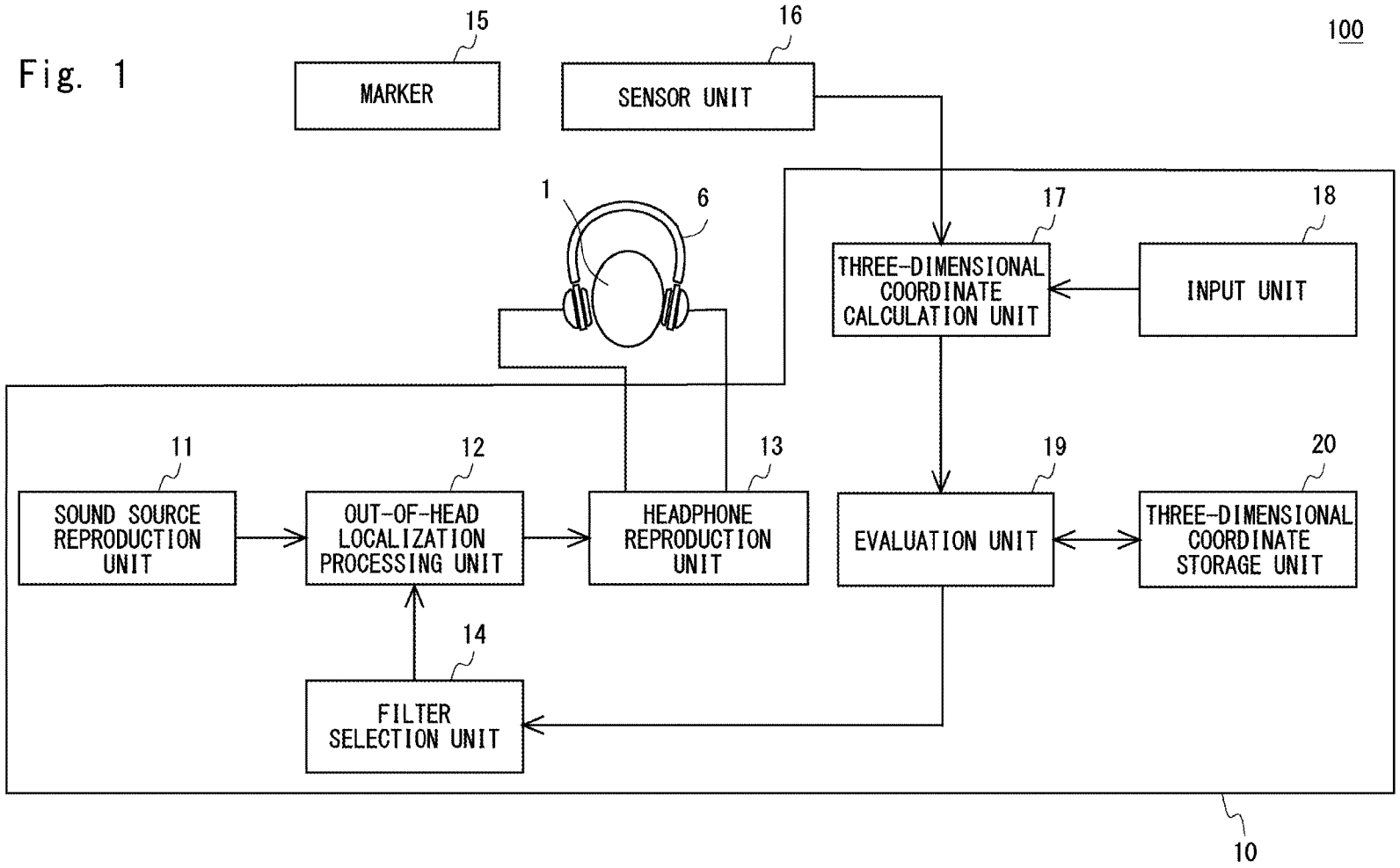
FIG. 1 is a block diagram showing an out-of-head localization processing apparatus according to embodiments.
Figure 2:
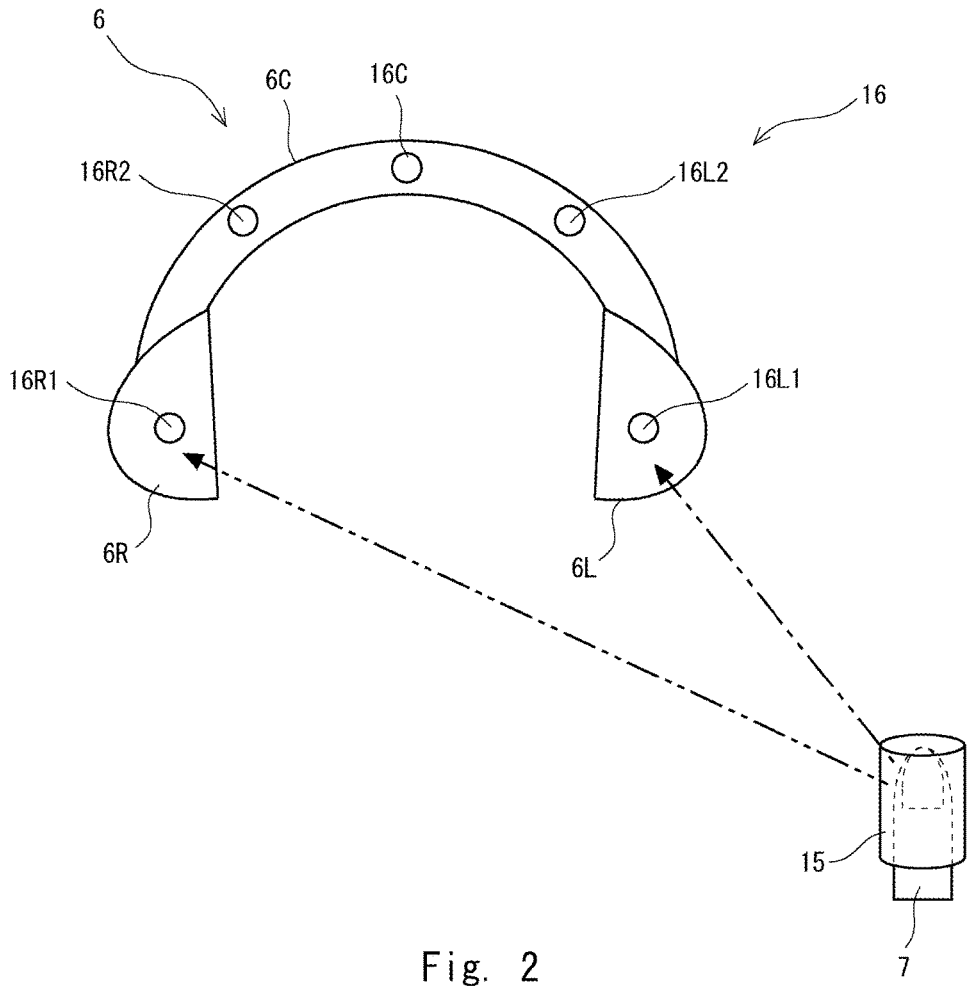
FIG. 2 is a diagram showing a configuration of headphones on which a sensor unit is mounted.

An out-of-head localization processing apparatus and a filter selection method according to this embodiment will be described with reference to FIGS. 1 and 2. FIG. 1 is a block diagram showing a configuration of an out-of-head localization processing apparatus 100. FIG. 2 is a diagram showing a configuration of headphones on which a sensor unit is mounted.

As shown in FIG. 1, the out-of-head localization processing apparatus 100 includes a marker 15, a sensor unit 16, headphones 6, and a processing apparatus 10.

A user 1 who is a listener wears the headphones 6. The headphones 6 can output Lch signals and Rch signals to the user 1. Further, as shown in FIG. 2, the user 1 wears the marker 15 on his/her finger 7. The sensor unit 16 is attached to the headphones 6. The sensor unit 16 detects the marker 15 worn on the user 1's finger 7.

The headphones 6 are band type headphones and includes a left housing 6L, a right housing 6R, and a headband 6C. The left housing 6L outputs the Lch signals to the user 1's left ear. The right housing 6R outputs the Rch signals to the user 1's right ear. The left and right housings 6L and 6R each include therein an output unit including a diaphragm and the like. The headband 6C is formed in an arc shape and connects the left housing 6L and the right housing 6R. The headband 6C is put on the user 1's head. Then, the head of the user 1 is sandwiched between the left and right housings 6L and 6R. The left housing 6L is worn on the user 1's left ear, and the right housing 6R is worn on the user 1's right ear.

The sensor unit 16 is placed on the headphones 6. A sensor array including a plurality of sensors 16L1, 16L2, 16C, 16R2, and 16R1 can be used for the sensor unit 16. The sensor L1 is attached to the left housing 6L. The sensor 16R1 is attached to the right housing 6R. The sensors 16L2, 16C, and 16R2 are attached to the head band 6C.

The sensor 16C is disposed at the center of the headband 6C. The sensor 16L2 is disposed between the sensor 16L1 and the sensor 16C. The sensor 16R2 is disposed between the sensor 16R1 and the sensor 16C. In this way, the sensor 16L2, the sensor 16C, and the sensor 16R2 are disposed along the headband 6C between the sensor 16L1 and the sensor 16R1.

Although FIG. 2 shows an example in which the sensor unit 16 includes five sensors 16L1, 16L2, 16C, 16R2, 16R1, the number and positions of the sensors are not limited in particular. A plurality of sensors may be placed on the left and right housings 6L and 6R or on the head band 6C of the headphones 6.

In this example, the sensors 16L1, 16L2, 16C, 16R2, and 16R1 are optical sensors, and the sensor unit 16 detects the markers 15. For example, when the marker 15 having a light emitter is used, the sensors 16L1, 16L2, 16C, 16R2, and 16R1 each include a light receiving element that receives light from the marker 15. Then, the sensor unit 16 detects the position of the marker 15 by a difference between respective times at which the light from the marker 15 arrives at each of the sensors 16L1, 16L2, 16C, 16R2, and 16R1.

Alternatively, when the marker 15 having a reflector is used, the sensors 16L1, 16L2, 16C, 16R2, and 16R1 each include a light emitting element and a light receiving element. Then, the light emitting elements of the respective sensors 16L1, 16L2, 16C, 16R2, 16R1 emit light at different frequencies (wavelengths). The light receiving elements of the respective sensors 16L1, 16L2, 16C, 16R2, and 16R1 detect light at the respective frequencies, which is reflected by the marker 15. The positional relationship with the marker 15 can be measured from the time when the light receiving elements of the sensors 16L1, 16L2, 16C, 16R2, and 16R1 detect the light.

The plurality of sensors 16L1, 16L2, 16C, 16R2, and 16R1 arranged in an arc are placed on the left and right housings 6L and 6R, and the head band 6C of the headphones 6. Thus, the sensor unit 16 can detect the position of the marker in the horizontal direction, the vertical direction, and the depth direction (front-rear direction).

Note that the method for detecting the position of the marker 15 is not limited in particular. For example, each sensor may not be an optical sensor and instead may be an electromagnetic sensor or the like. It is obvious that the sensor unit 16 may directly detect the position of the user 1's finger or the like instead of the position of the marker 15. In such a case, the user 1 may not wear the marker 15. In addition, some or all of the sensors provided in the sensor unit 16 may be attached to something other than the headphones 6. Alternatively, the sensor unit may be worn on the user 1's finger 7, and the markers 15 may be placed on the headphones 6. Then, the position of the marker placed on the headphones 6 is detected by the sensor unit worn on the user 1's finger 7.

The processing apparatus 10 is an arithmetic processing apparatus such as a personal computer. The processing apparatus 10 includes a processor, a memory, and the like. The processing apparatus 10 includes a sound source reproduction unit 11, an out-of-head localization processing unit 12, a headphone reproduction unit 13, a filter selection unit 14, a three-dimensional coordinate calculation unit 17, an input unit 18, an evaluation unit 19, and a three-dimensional coordinate storage unit 20.

The processing apparatus 10 performs processing for selecting a filter optimal for the user 1. By the processing of the processing apparatus 10, a listening test for selecting the optimal filter is executed. Note that the processing apparatus 10 is not limited to a physically single apparatus, and a part of the processing may be performed by another apparatus different from the processing apparatus 10. For example, a part of the processing may be performed by a personal computer or the like, and the rest of the processing may be performed by a DSP (Digital Signal Processor) or the like included in the headphones 6. Alternatively, the three-dimensional coordinate calculation unit 17 may be provided in the sensor unit 16.

The sound source reproduction unit 11 reproduces a test sound source. It is preferable that the test sound source is a sound source in which a localized position of a sound image is easily detected. For example, as a test sound source, a single sound source such as white noise may be used. The test sound source is stereo signals containing the Lch signals and the Rch signals. The sound source reproduction unit 11 outputs reproduced signals to the out-of-head localization processing unit 12.

The out-of-head localization processing unit 12 performs out-of-head localization processing on the signals of the test sound source. The out-of-head localization processing unit 12 reads preset filters stored in the filter selection unit 14 and performs the out-of-head localization processing. For example, the out-of-head localization processing unit 12 executes a convolution operation. In the convolution operation, a filter of the head-related transfer characteristics and an inverse filter of the ear canal transfer characteristics are convolved with the reproduced signals.

The filter of the head-related transfer characteristics is not the filter for the listener himself/herself and instead is selected in advance by the filter selection unit 14 from the plurality of preset filters prepared in advance. The preset filter selected by the filter selection unit 14 is set in the out-of-head localization processing unit 12. The ear canal transfer characteristics can be measured by microphone built in the headphones. Alternatively, a fixed value measured using a dummy head or the like may be used for the ear canal transfer characteristics. Note that in the filter selection unit 14, the preset filters for the left and right ears are respectively prepared.

The headphone reproduction unit 13 outputs, to the headphones 6, the reproduced signals on which the out-of-head localization processing has been executed by the out-of-head localization processing unit 12. The headphones 6 output the reproduced signals to the user. In this way, the out-of-head localized sound, which is reproduced as if it is reproduced from speakers, is reproduced from the headphones 6 as a test sound.

In the filter selection unit 14, n (n is an integer of two or greater) preset filters are stored. The filter selection unit 14 selects one of the n preset filters and outputs the selected one to the out-of-head localization processing unit 12. Furthermore, the filter selection unit 14 sequentially switches the one to n preset filters and outputs them to the out-of-head localization processing unit 12. The out-of-head localization processing unit 12 performs the out-of-head localization processing using the one to n preset filters selected by the filter selection unit 14. The selection of the preset filter by the filter selection unit 14 may be manually switched by the user 1 or may be automatically switched in order every few seconds. In the following descriptions, the preset number is assumed to be eight. However, the preset number is not limited in particular.

As described above, the sensor unit 16 detects the position of the marker 15. The input unit 18 receives a user input for determining the localized position of the sound image by the out-of-head localization processing. The input unit 18 includes a button or the like for accepting the user input. The position of the marker 15 at the timing when the button is pressed is the localized position of the sound image. The input unit 18 is not limited to a button but may be other input devices such as a keyboard, a mouse, a touch panel, a lever, or the like. Further, the localized position may be determined by a voice input via, for example, a microphone or may be determined when resting of the marker 15 for a predetermined time or longer is detected.

For example, when the user 1 is listening to the reproduced signals, which have been subjected to the out-of-head localization processing, with the headphones 6, the user 1 specifies the localized position of the sound image with the finger 7 wearing the marker 15. That is, the user 1 points, with the marker 15, to where he/she listens to the sound image is localized. When the user 1 moves the marker 15 to the localized position of the sound image, the user 1 presses the button of the input unit 18. Then, the localized position of the sound image can be determined.

The three-dimensional coordinate calculation unit 17 calculates the three-dimensional coordinates of the localized position of the sound image based on an output from the sensor unit 16. For example, the sensor unit 16 generates a detection signal indicating position information of the marker 15 according to a result of the detection of the position of the marker 15 and outputs the detection signal to the three-dimensional coordinate calculation unit 17. Further, the input unit 18 outputs an input signal corresponding to the user input to the three-dimensional coordinate calculation unit 17. The three-dimensional coordinate calculation unit 17 calculates, as the three-dimensional coordinates of the localized position, a three-dimensional position of the marker 15 at the timing when the input unit 18 makes the determination. In this way, the three-dimensional coordinate calculation unit 17 calculates the three-dimensional coordinates of the marker 15 based on the detection signal from the sensor unit 16.

The three-dimensional coordinate calculation unit 17 calculates the three-dimensional coordinates for each preset filter. The three-dimensional coordinate calculation unit 17 outputs the calculated three-dimensional coordinates to the evaluation unit 19. The evaluation unit 19 stores, in the three-dimensional coordinate storage unit 20, the three-dimensional coordinates calculated for the preset filter. The three-dimensional coordinate storage unit 20 includes a memory and the like and stores eight three-dimensional coordinates.

The evaluation unit 19 evaluates the optimal filter based on the plurality of three-dimensional coordinates stored in the three-dimensional coordinate storage unit 20. That is, the evaluation unit 19 determines the preset filter having the best out-of-head localization performance for the user 1 as the optimal filter. In the first embodiment, the evaluation unit 19 evaluates, as the optimal filter, the preset filter that provides the localized position farthest from the user 1 and spreading to the left and right.

In this way, the evaluation unit 19 selects the optimal filter from the plurality of preset filters. Therefore, it is possible to easily select the head-related transfer characteristics optimal for the user 1 from a large number of preset values.

In the reproduction of the actual sound source, the out-of-head localization processing unit 12 performs the out-of-head localization processing using the optimal filter. Then, the headphones 6 reproduce the Lch signals and the Rch signals that have been subjected to the out-of-head localization processing using the optimal filter. Note that stereo music signals output from a CD (Compact Disc) player or the like are used for reproducing the actual sound source. In this manner, the out-of-head localization processing can be performed using an appropriate filter. Even when the headphones 6 are used, the out-of-head localization characteristics optimal for the user 1 can be obtained.

Note that the reproduction of the actual sound source and the reproduction of the test sound source are not limited to those performed by the same apparatus and instead may be performed by different apparatuses. For example, the optimal filter selected by the out-of-head localization processing apparatus 100 is wirelessly or wiredly transmitted to another music player or the headphones 6. The other music player or headphones 6 store the optimal filters. Then, the other music player or the headphones 6 perform the out-of-head localization processing on the stereo music signals using the optimal filter.

Figure 3:
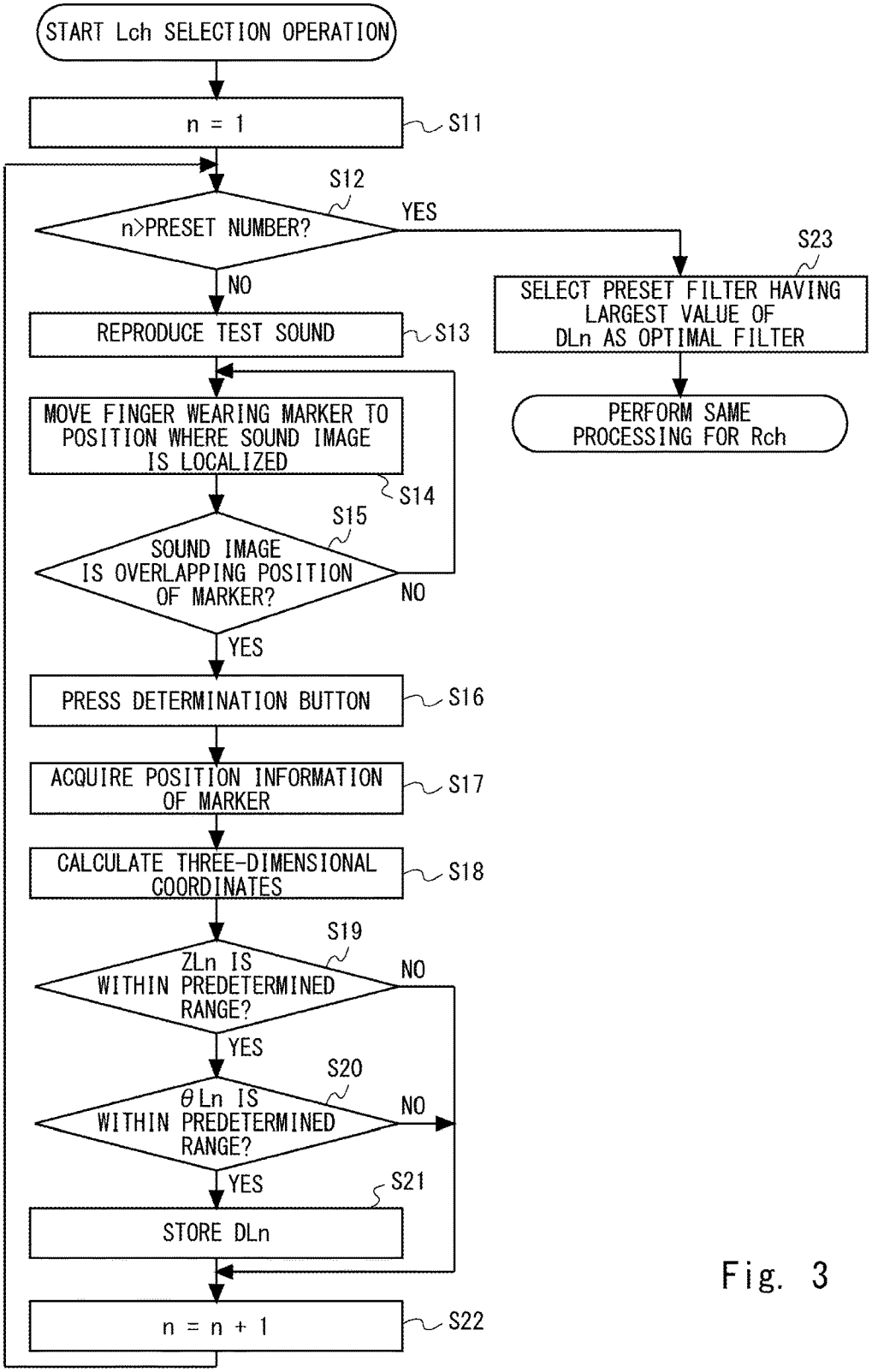
FIG. 3 is a flowchart showing a filter selection method according to a first embodiment.

A filter selection method according to the first embodiment will be described with reference to FIG. 3. FIG. 3 is a flowchart showing the filter selection method performed by the out-of-head localization processing apparatus 100. In FIG. 3, processing for Lch is shown. The preset filters for the left and right ears, respectively, are prepared in the filter selection unit 14. The listening test is performed separately for the filter of Lch and the filter of Rch. However, as the processing for Lch and Rch are the same, the description of the processing for Rch is omitted as appropriate.

When an Lch selection operation is started, n=1 (Step S11). The n is a preset filter number. Firstly, processing for the first preset filter is performed. The filter selection unit 14 evaluates as to whether or not n is greater than the preset number (Step S12). Here, as the preset number is eight, n is smaller than the preset number (NO in Step S12).

Then, the sound source reproduction unit 11 reproduces the test sound using the first preset filter (Step S13). In this example, the out-of-head localization processing unit 12 executes the out-of-head localization processing using the first preset filter. Specifically, the out-of-head localization processing unit 12 executes the out-of-head localization processing on the stereo signals of the test sound source by using the preset filter for Lch. Then, the headphone reproduction unit 13 outputs the Lch signals from the housing 6L of the headphones 6 to the user 1.

Next, the user 1 moves his/her finger wearing the marker 15 to a place where he/she listens to the sound image is localized (Step S14). That is, the user 1 moves his/her finger 7 to the localized position of the sound image formed by the headphones 6. Then, the user 1 evaluates as to whether or not the sound image and the position of the marker 15 overlap (Step S15). When the localized position of the sound image does not match the position of the marker 15 (NO in Step S15), the process returns to Step S14. In Step S14, the user 1 moves his/her finger 7 wearing the marker 15 to the position where the sound image is localized.

When the localized position of the sound image specified by the user 1 matches the position of the marker 15 (YES in Step S15), the user 1 presses a determination button (Step S16). That is, the user 1 operates the input unit 18 to determine the localized position. Then, the input unit 18 receives an input for determining the localized position of the sound image.

When the input unit 18 accepts the user input of pressing the button, the sensor unit 16 acquires the position information of the marker 15 (Step S17). Then, the three-dimensional coordinate calculation unit 17 calculates the three-dimensional coordinates of the localized position based on the position information from the sensor unit 16 (Step S18). That is, the three-dimensional coordinate calculation unit 17 calculates the three-dimensional coordinates of the marker 15 as the three-dimensional coordinates of the localized position.

Figure 4:
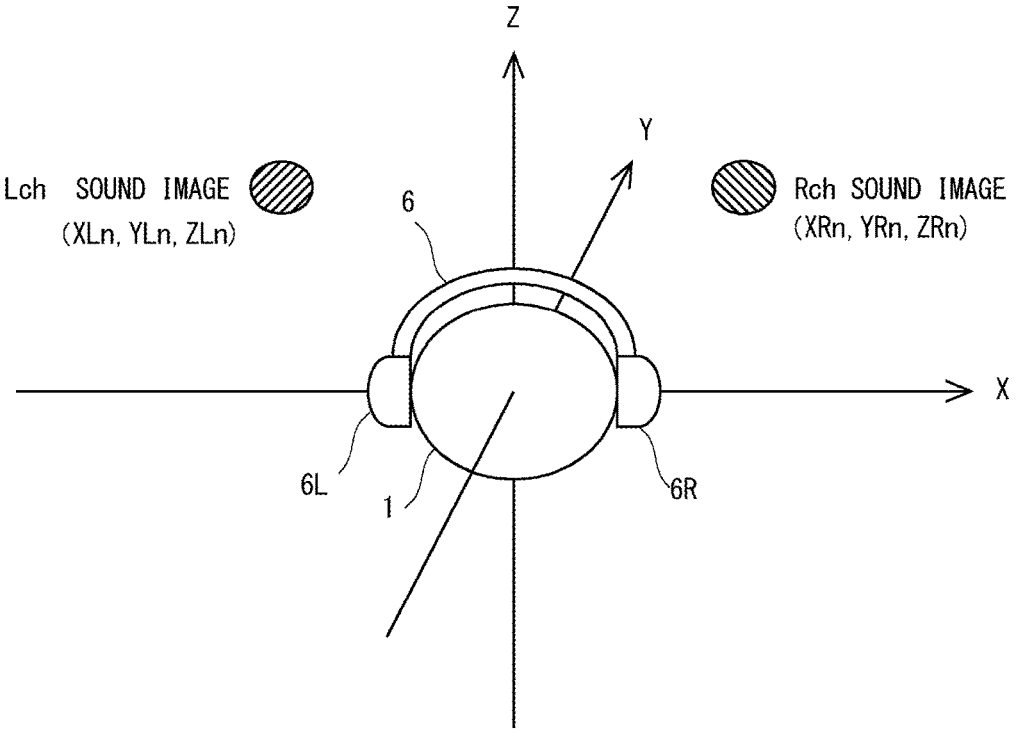
FIG. 4 is a diagram for describing a three-dimensional coordinate system of a localized position.

Here, the three-dimensional coordinates calculated by the three-dimensional coordinate calculation unit 17 will be described with reference to FIG. 4. FIG. 4 shows a three-dimensional orthogonal coordinate system in which, as seen from the user 1, a left-right direction is an X-axis, a front-rear direction is a Y-axis, and an up-down direction is a Z-axis. More specifically, with respect to the user 1, a right direction is a +X direction, a left direction is a −X direction, a forward direction is a +Y direction, a backward direction is a −Y direction, an upward direction is a +Z direction, and a downward direction is a −Z direction. Note that an origin of the three-dimensional coordinate system is the middle of the left and right housings 6L and 6R, i.e., the center of the user 1's head.

Here, the three-dimensional coordinate calculation unit 17 obtains three-dimensional coordinates (XLn, YLn, ZLn) of a sound image for Lch. Note that XLn, YLn, and ZLn are relative XYZ coordinates from the origin. The XLn, YLn, and ZLn are as follows.

XLn: Relative coordinates in the X-axis direction from the user 1 to the Lch sound image by the nth filter YLn: Relative coordinates in the Y-axis direction from the user 1 to the Lch sound image by the nth filter ZLn: Relative coordinates in the Z-axis direction from the user 1 to the Lch sound image by the nth filter In this embodiment, the three-dimensional coordinate calculation unit 17 calculates three-dimensional coordinates (XLn, YLn, ZLn). The three-dimensional coordinate calculation unit 17 outputs the three-dimensional coordinates (XLn, YLn, ZLn) to the evaluation unit 19. In this embodiment, the evaluation unit 19 evaluates the optimal filter based on a distance DLn from the user 1 to the localized position of the sound image. More specifically, the evaluation unit 19 evaluates, as the optimal filter, the filter in which the localized position of the obtained sound image is far from the user 1 and spreading to the left and right. Furthermore, the filter in which the height of the sound image is in the vicinity of the ear is determined as the optimal filter.

Therefore, the evaluation unit 19 evaluates as to whether or not ZLn is within a predetermined range (Step S19). That is, the evaluation unit 19 evaluates as to whether or not the height of the sound image is about the same height as the height of the ears. The relative height of the sound image from the ears is represented by ZLn. Commonly, it is desirable that the sound image of the stereo sound source be at the same height as that of the ears. When the height ZLn of the sound image is too high or too low from the ears, the 2ch sound image localization would give an unnatural impression.

Therefore, if ZLn is not within the predetermined range (NO in Step S19), the process proceeds to Step S22. By doing so, the preset filter with a too high localized position and the preset filter with a too low localized position are removed from the group of the preset filters from which preset filters are to be selected. Although the range of differences in height of the sound images may be arbitrarily set, it is desirable to set it within a range of about plus or minus 20 cm from the height of the ears. In Step S19, it is evaluated as to whether or not the value of ZLn is within a predetermined range. Alternatively, it may be evaluated as to whether or not an angle of the sound image in the up-down direction, i.e., an angle (elevation angle) from a horizontal plane, is within a predetermined range.

When ZLn is within the predetermined range (YES in Step S19), the evaluation unit 19 evaluates as to whether or not θLn is within a predetermined range (Step S20). That is, the evaluation unit 19 evaluates as to whether or not an opening angle of the sound image is within the predetermined range. The angle θLn in the horizontal plane of the sound image localization when the front of the user 1 is assumed to be 0° can be expressed by the following equation (1).

$$\theta Ln = \tan^{-1}(YLn/XLn) \tag{1}$$

The θLn is an angle from the Y-axis in the horizontal plane (XY plane). When θLn is large, the sound gives a strong feeling of stereophonic sound. However, when θLn is too large, a state of, so-called, weak central sound occurs, thereby giving an unnatural impression. Accordingly, θLn is desirably in the range of $-45° \leq \theta Ln \leq 20°$. It is obvious that the range of the opening angle is not limited to the above value.

When θLn is not within the predetermined range (NO in Step S20), the process proceeds to Step S22. Then, the preset filter having an opening angle of the Lch sound image too large and the preset filter having an opening angle of the Lch sound image too small are removed from the preset filters from which preset filters are to be selected.

When θLn is within the predetermined range (YES in Step S20), the three-dimensional coordinate storage unit 20 stores the distance from the user 1 DLn to the sound image (Step S21). The distance DLn is the distance from the user 1 to the sound image. The distance DLn is expressed by the following equation (2).

$$DLn = (XLn^2 + YLn^2 + ZLn^2)^{1/2} \tag{2}$$

The three-dimensional coordinate storage unit 20 stores the distance DLn calculated by the evaluation unit 19. Then, n is incremented as in n=n+1 (Steps S22). After n is incremented, the process returns to Step S12. Then, the processing from Step S12 to Step S22 is repeated until n reaches the preset number. That is, for the second to eighth preset filters, the processing from Step S12 to Step S22 is performed.

In Step S12, when n exceeds the preset number (YES in Step S12), the process proceeds to Step S23. The same processing is performed on all the preset filters that have been preset to calculate the distance DLn. Here, n=8. Therefore, when there are no preset filters that are removed from the preset filters from which preset filters are to be selected in Steps S19 and S20, the evaluation unit 19 calculates eight distances DL1 to DL8.

When n exceeds the preset number (YES in Step S12), the present filter having the largest value of the distance DLn among the eight distances DL1 to DL8 is selected as the optimal filter (Step S23). That is, the evaluation unit 19 selects the preset filter having the largest distance DLn as the optimal filter. In this way, it is possible to select the preset filter having the sound image localized farthest from the user 1 as the optimal filter. As described above, the evaluation unit 19 compares the distances DL1 to DL8 stored in the three-dimensional coordinate storage unit 20 with one another and selects the optimal filter.

After the selection of the Lch optimal filter is completed, the same processing is performed for Rch. Processing for Rch is similar to that for Lch. In the processing for Rch, the out-of-head localization processing is performed on the stereo signals of the test sound source using the preset filter for Rch. Then, the Rch signals are output from the housing 6 R of the headphones 6 to the right ear of the user 1.

Like Lch, the three-dimensional coordinates calculated by the three-dimensional coordinate calculation unit 17 shall be (XRn, YRn, ZRn) for the Rch sound image.

XRn: Relative coordinates in the X-axis direction from the user 1 to the Rch sound image by the nth filter YRn: Relative coordinates in the Y-axis direction from the user 1 to the Rch sound image by the nth filter ZRn: Relative coordinates in the Z-axis direction from the user 1 to the Rch sound image by the nth filter In the case of Rch, in Step S19, it is evaluated as to whether or not ZRn is within a predetermined range. In Step S20, it is evaluated as to whether or not θRn is within a predetermined range. The angle θRn in the horizontal plane of the sound image localization when the front of the user 1 is assumed to be 0° can be expressed by the following equation (3).

$$\theta Rn = \tan^{-1}(YRn/XRn) \tag{3}$$

The θRn is an angle from the Y-axis in the horizontal plane (XY plane). Like Lch, when θRn is large, the sound gives a strong feeling of stereophonic sound. However, when θRn is too large, a state of, so-called, weak central sound occurs, thereby giving an unnatural impression. Accordingly, θRn is desirably in the range of $20° \leq \theta Rn \leq 45°$. It is obvious that the range of the opening angle is not limited to the above value. Note that the ranges of the opening angles may be bilaterally symmetric or asymmetric between Lch and Rch.

In the case of Rch, in Step S21, distances DRn are stored. In Step S23, the optimal filter is selected by comparing the distances DRn to one another. The distance DRn from the user 1 to the sound image of the Rch can be expressed by the following equation (4).

$$DRn=(XRn^2+YRn^2+ZRn^2)^{1/2} \quad (4)$$

As described above, the evaluation unit 19 evaluates the optimal filter by comparing the three-dimensional coordinates calculated for each preset filter. By doing so, it is possible to select a preset filter having the highest out-of-head localization performance for the user 1 as the optimal filter. It is obvious that the order of processing Lch and Rch may be reversed. Furthermore, the Lch preset filter and the Rch preset filter may be alternately used.

In this embodiment, the localized position of the sound image is detected by the marker 15 placed in the headphones 6. Then, the optimal filter is selected based on the three-dimensional coordinates of the localized position of the sound image. Thus, it is possible to easily select the filter optimal for the user from a plurality of preset filters prepared in advance. The evaluation unit 19 compares the three-dimensional coordinates of the localized positions calculated for the respective preset filters and selects the optimal filter. Therefore, the user can select the optimal filter without comparing the localized positions of the sound images for the respective preset filters. Accordingly, the optimal filter can be easily selected.

Second Embodiment

In this embodiment, processing in the evaluation unit 19 is different from that in the first embodiment. Specifically, in this embodiment, the optimal filter is evaluated by comparing the three-dimensional coordinates calculated for each preset filter with preset three-dimensional coordinates of virtual speakers. As the processing other than the processing in the evaluation unit 19 is the same as that in the first embodiment, the description is omitted as appropriate. For example, the configuration of the apparatus in the second embodiment has the same configuration as that shown in FIGS. 1 and 2.

Figure 5:
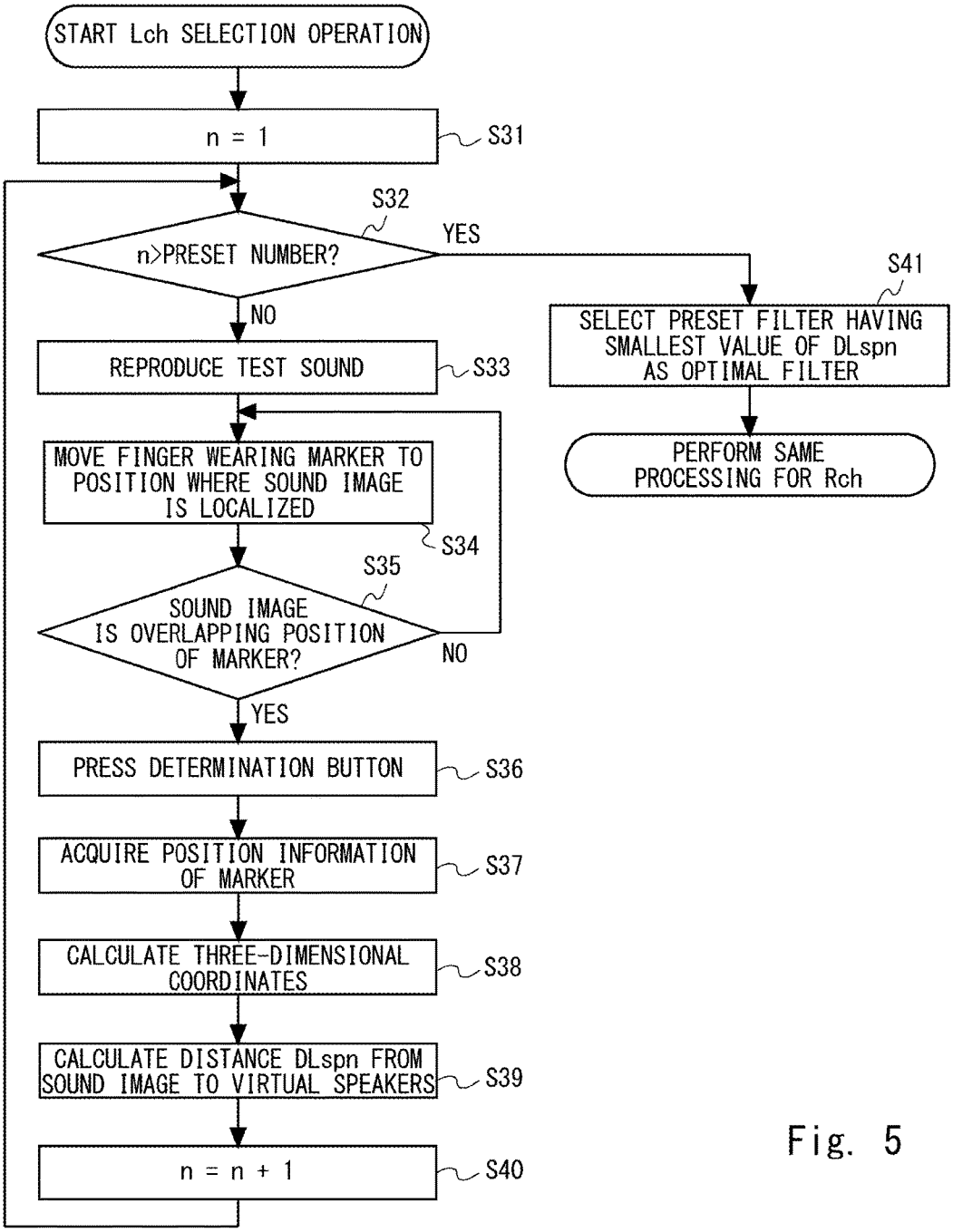
FIG. 5 is a flowchart showing the filter selection method according to the second embodiment.
Figure 6:
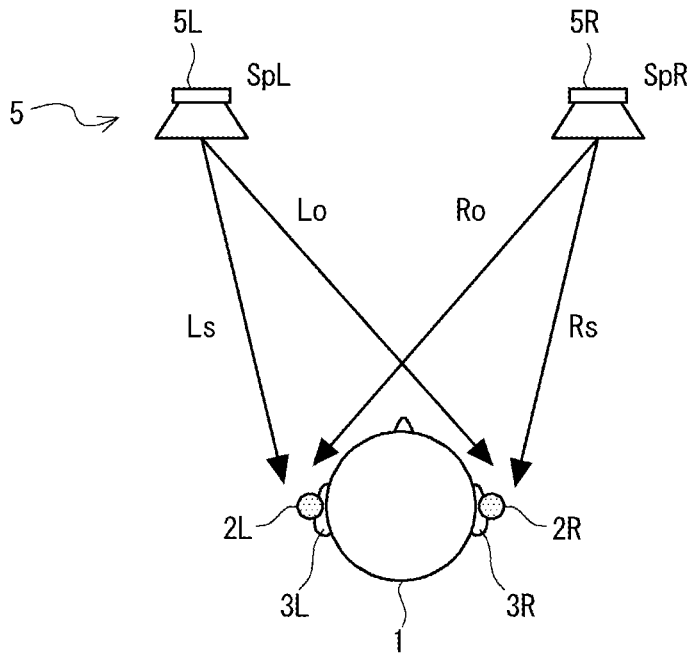
FIG. 6 is a diagram showing a measurement apparatus for measuring head-related transfer characteristics.

FIG. 5 is a flowchart showing a filter selection method performed by the out-of-head localization processing apparatus 100 according to this embodiment. As the basic processing in the out-of-head localization processing apparatus 100 is the same as that in the first embodiment, the description is omitted as appropriate. For example, as Steps S31 to S38 and S40 correspond to Steps S11 to S18 and S22 of the first embodiment, respectively, the descriptions thereof will be omitted.

In this embodiment, the evaluation unit 19 calculates a distance DLspn from the sound image to the virtual speakers (Step S39). The three-dimensional coordinates of the virtual speakers are previously set. The three-dimensional coordinates of the relative position of the Lch virtual speaker shall be (XLsp, YLsp, ZLsp). The three-dimensional coordinates of the relative position of the sound image is (XLn, YLn, ZLn), as indicated in the first embodiment. The distance DLspn between the sound image by the nth preset filter and the virtual speaker can be expressed by the following equation (5).

$$DLspn=\{(XLn-XLsp)^2+(YLn-YLsp)^2+(ZLn-ZLsp)^2\}^{1/2} \quad (5)$$

The distance DLspn calculated by the evaluation unit 19 is stored in the three-dimensional coordinate storage unit 20. Then, n is incremented as in n=n+1 (Steps S40), and the same processing is executed for the next preset filter (Steps S31 to S39). Steps S31 to S39 are repeated until n exceeds the preset number (YES in Step S32). The evaluation unit 19 calculates the distance DLspn for each preset filter. When n=8, the three-dimensional coordinate storage unit 20 stores eight distances DLsp1 to DLsp8.

Then, the evaluation unit 19 selects the preset filter having a value of the distance DLspn smallest among the distances DLsp1 to DLsp8 as the optimal filter. As described above, in this embodiment, the evaluation unit 19 selects the preset filter having the sound image localized at the position closest to the virtual speakers as the optimal filter.

When the processing for Lch is completed, the same processing is performed on Rch. The three-dimensional coordinates of the relative position of the Rch virtual speaker shall be (XRsp, YRsp, ZRsp). As indicated in the first embodiment, the three-dimensional coordinates of the relative position of the Rch sound image is (XRn, YRn, RLn). The distance DRspn between the sound image by the nth preset filter and the virtual speaker can be expressed by the following equation (6).

$$DRspn=\{(XRn-XRsp)^2+(YRn-YRsp)^2+(ZRn-ZRsp)^2\}^{1/2} \quad (6)$$

The evaluation unit 19 calculates the distance DRspn for each preset filter. Therefore, the three-dimensional coordinate storage unit 20 stores n distances DRspn. Then, the evaluation unit 19 selects the preset filter having a value of the distance DRspn the smallest among the n distances DRspn as the optimal filter. In this embodiment, the evaluation unit 19 selects the preset filter having the sound image localized at the position closest to the virtual speakers as the optimal filter. By doing so, it is possible to reproduce music reproduction signals with high out-of-head localization performance. Additionally, it is possible to localize the sound image at a position close to the virtual speakers.

Third Embodiment

In the second embodiment, a method for selecting a sound image close to a preset position of the virtual speakers is described. In the third embodiment, the user 1 arbitrarily sets the position of the virtual speakers. Then, a preset filter having a sound image closest to the position of the virtual speakers set by the user 1 is selected as the optimal filter.

For example, the position of the virtual speakers can be changed according to the preference of the user 1. For example, it is also possible to set an opening angle of the virtual speakers to the left and right larger, or to set the sound image not so it is not located too far from the user's head. Therefore, it is possible to localize the sound image in the direction desired by the user 1.

Before selecting the preset filter, the user presses the position determination button with the finger wearing the marker 15 placed at the positions where he/she wants to localize the left and right speakers respectively. By doing so, the user 1 can set the position of the virtual speaker. That is, the three-dimensional coordinate calculation unit 17 calculates three-dimensional coordinates (XLsp, YLsp, ZLsp) of the virtual speaker based on the position information of the marker 15 from the sensor unit 16. Then, the evaluation unit 19 stores the three-dimensional coordinates of the virtual speakers.

After that, in a manner similar to the second embodiment, the position of the sound image localization is indicated with the marker while listening to the test sound source processed by the filter of each preset and the position of the sound image localization is stored. Next, the preset filter with the relative distance closest to the virtual speakers is selected as the filter with the highest out-of-head localization performance. By doing so, it is possible to bring the sound image closer to the position of the virtual speaker according to the preference of the user 1.

A part or all of the signal processing may be executed by a computer program. The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

Although the present disclosure has been described with reference to the embodiments, the present disclosure is not limited by the above descriptions. Various changes that can be understood by those skilled in the art within the scope of the invention can be made to the configuration and details of the present disclosure.

The present disclosure is preferable for an out-of-head localization processing apparatus using headphones.

What is claimed is:

1. An out-of-head localization processing apparatus comprising:

headphones configured to output a signal to a user;

a sensor configured to generate a detection signal indicating position information;

a memory configured to store a plurality of preset filters and instructions;

at least one processor operably coupled to the memory, headphones, and sensor, the at least one processor configured to execute the instructions to:

reproduce a test sound source;

select, from the plurality of preset filters, a preset filter to be used for out-of-head localization processing;

perform the out-of-head localization processing on a signal of the test sound source using the preset filter selected by the filter selection unit;

output, to the user via the headphones, the signal that has been subjected to the out-of-head localization processing by the out-of-head localization processing unit;

accept a user input for determining a localized position of a sound image in the out-of-head localization processing;

receive the detection signal from the sensor, the detection signal indicating position information of the localized position pointed to by the user;

calculate three-dimensional coordinates of the localized position based on the detection signal from the sensor; and evaluate, based on the three-dimensional coordinates of the localized position of each of the preset filters, a filter optimal for the user from the plurality of preset filters.

2. The out-of-head localization processing apparatus according to claim 1, wherein the sensor is configured to detect a marker worn by the user on a finger, and the at least one processor is further configured to calculate the three-dimensional coordinates of the localized position based on the position information of the marker.

3. The out-of-head localization processing apparatus according to claim 1, wherein the sensor is placed on the headphones.

4. The out-of-head localization processing apparatus according to claim 3, wherein the headphones comprise:

left and right housings; and a head band connecting the left and right housings, and the sensor comprises a plurality of sensors placed on the left and right housings or the head band.

5. The out-of-head localization processing apparatus according to claim 1, wherein the sensor worn by the user on a finger is configured to detect a marker placed on the headphones, and the at least one processor is further configured to calculate the three-dimensional coordinates of the localized position based on the position information of the marker.

6. The out-of-head localization processing apparatus according to claim 1, wherein the at least one processor is further configured to calculate a distance between the user and the localized position using the three-dimensional coordinates of the localized position of each of the preset filters, and the optimal filter is evaluated based on the distance between the user and the localized position of each of the preset filters.

7. The out-of-head localization processing apparatus according to claim 1, wherein the at least one processor is further configured to calculate a distance between a virtual speaker and the localized position using the three-dimensional coordinates of the localized position of each of the preset filters and preset three-dimensional coordinates of the virtual speaker, and the optimal filter is evaluated based on the distance between the virtual speaker and the localized position of each of the preset filters.

8. A filter selection method comprising:

selecting, from a plurality of preset filters stored in a memory, a preset filter to be used for out-of-head localization processing;

outputting a signal of a test sound source that has been subjected to the out-of-head localization processing using the selected preset filter;

accepting a user input for determining a localized position of a sound image in the out-of-head localization processing, the localized position being pointed to by the user;

acquiring, by a sensor, position information of the localized position pointed to by the user;

calculating three-dimensional coordinates of the localized position based on the position information; and selecting, based on the three-dimensional coordinates of the localized position of each of the preset filters, an optimal filter from the plurality of preset filters.

9. The filter selection method according to claim 8, wherein the sensor is configured to detect a marker worn by the user on a finger, the three-dimensional coordinates of the localized position are calculated based on the position information of the marker.

10. The filter selection method according to claim 8, wherein the sensor is placed on the headphones.

11. The filter selection method according to claim 10, wherein the headphones comprise:

left and right housings; and a head band connecting the left and right housings, and the sensor comprises a plurality of sensors placed on the left and right housings or the head band.

12. The filter selection method according to claim 8, wherein the sensor worn by on the user's finger detects the marker placed on the headphones, and the three-dimensional coordinates of the localized position are calculated based on the position information of the marker.

13. The filter selection method according to claim 8, wherein a distance between the user and the localized position is calculated using the three-dimensional coordinates of the localized position of each of the preset filters, and the optimal filter is evaluated based on the distance between the user and the localized position of each of the preset filters.

14. The filter selection method according to claim 8, wherein a distance between a virtual speaker and the localized position is calculated using the three-dimensional coordinates of the localized position of each of the preset filters and preset three-dimensional coordinates of the virtual speaker, and the optimal filter is evaluated based on the distance between the virtual speaker and the localized position of each of the preset filters.

15. A filter selection apparatus comprising:

headphones configured to output a signal to a user;

a sensor configured to generate a detection signal indicating position information;

a memory configured to store a plurality of preset filters and instructions;

at least one processor operably coupled to the memory, headphones, and sensor, the at least one processor configured to execute the instructions stored in the memory to:

reproduce a test sound source;

select, from the plurality of preset filters, a preset filter to be used for out-of-head localization processing;

perform the out-of-head localization processing on a signal of the test sound source using the preset filter selected by the filter selection unit;

output, to the user via the headphones, the signal that has been subjected to the out-of-head localization processing by the out-of-head localization processing unit;

accept a user input for determining a localized position of a sound image in the out-of-head localization processing;

receive the detection signal from the sensor, the detection signal indicating position information of the localized position pointed to by the user;

calculate three-dimensional coordinates of the localized position based on the detection signal from the sensor; and evaluate, based on the three-dimensional coordinates of the localized position of each of the preset filters, a filter optimal for the user from the plurality of preset filters.

* * * * *